US006726296B2

(12) United States Patent
McGilton

(10) Patent No.: US 6,726,296 B2
(45) Date of Patent: Apr. 27, 2004

(54) CABINET AND UNDERSINK DRAWERS

(76) Inventor: James McGilton, 1229 Hoffman, Royal Oak, MI (US) 48067

( * ) Notice: Subject to any disclaimer, the term of this patent is extended or adjusted under 35 U.S.C. 154(b) by 0 days.

(21) Appl. No.: 10/254,375

(22) Filed: Sep. 25, 2002

(65) Prior Publication Data

US 2004/0056569 A1 Mar. 25, 2004

(51) Int. Cl.[7] ..... A47B 77/06; A47B 97/00
(52) U.S. Cl. ..... 312/228; 312/278; 312/330.1
(58) Field of Search ..... 312/228, 228.1, 312/330.1, 278, 229, 334.1, 334.7, 348.3

(56) References Cited

U.S. PATENT DOCUMENTS

| | | | | | |
|---|---|---|---|---|---|
| 1,845,470 A | * | 2/1932 | Wood | ..... | 312/348.3 |
| 4,114,967 A | | 9/1978 | Weekly | | |
| 4,729,616 A | | 3/1988 | Vogt | | |
| 5,277,487 A | * | 1/1994 | Simon | ..... | 312/278 |
| 5,634,702 A | * | 6/1997 | Fistonich | ..... | 312/270.3 |
| 5,706,678 A | * | 1/1998 | Sasaki | ..... | 68/13 R |
| 6,224,176 B1 | | 5/2001 | Suzuki | | |

FOREIGN PATENT DOCUMENTS

| | | | | | |
|---|---|---|---|---|---|
| GB | 11714 | * | 5/1986 | ..... | 312/330.1 |
| SE | 24326 | * | 2/1907 | ..... | 312/330.1 |

* cited by examiner

*Primary Examiner*—James O. Hansen
(74) *Attorney, Agent, or Firm*—Reising, Ethington, Barnes, Kisselle, P.C.

(57) ABSTRACT

A cabinet including a frame structure that defines an interior space of the cabinet. Plumbing components are disposed within the interior space for connection to a sink mounted on a top of the frame structure. The drawer assembly is mounted within the interior space of the cabinet and is movable from open and closed positions along guides that are associated with the frame structure. The drawer assembly is configured to fit within the interior space of the cabinet when in the closed position without interference with plumbing components disposed within the interior space of the cabinet.

3 Claims, 4 Drawing Sheets

CABINET AND UNDERSINK DRAWERS

TECHNICAL FIELD

The invention generally relates to a cabinet structure for accommodating a sink, and more particularly, to a cabinet structure for accommodating a sink that includes a drawer assembly movable within the cabinet without interference with a plumbing fixture.

BACKGROUND OF THE INVENTION

Cabinets are generally known in the art for providing storage area for a variety of items. Also known in the art, are cabinets that are utilized as a base for mounting a sink. A top surface is generally mounted on the cabinet and a cutout is provided such that a sink may be mounted over the base cabinet. Plumbing components are usually disposed within the interior space of the cabinet to provide connections to the sink, such as hot and cold water, as well as, drain lines for transporting water from the sink. Generally, cabinets utilized for mounting a sink do not include drawers for storage due to the plumbing components described above. There is, therefore, a need in the art for a cabinet in which a sink can be mounted that includes a drawer assembly that is configured to fit within the interior space of the cabinet without interference with the plumbing components.

SUMMARY OF THE INVENTION

A cabinet including a frame structure having opposite side surfaces, a back surface, a front surface having an opening formed therein, and a top surface for mounting a sink. The frame structure defines an interior space of the cabinet. There is also included plumbing components disposed within the interior space of the cabinet for connection to the sink. A drawer assembly includes a drawer having opposing side surfaces, a front surface, a back surface, and a bottom surface. The drawer also includes guides to facilitate mounting of the drawer to the frame structure. The drawer assembly is mounted within the interior space of the cabinet and is movable from a closed position, where the drawer is completely housed within the interior space and a open position wherein at least a portion of the drawer assembly is positioned outside of the interior space of the cabinet to allow access to the drawer. The drawer assembly is configured to fit within the interior space when in the closed position without interference with the plumbing components.

BRIEF DESCRIPTION OF THE DRAWINGS

The foregoing and further objects, features and advantages of the present invention will become apparent from the following description of preferred embodiments and with reference to the accompanying drawings, wherein.

DETAILED DESCRIPTION OF THE PREFERRED EMBODIMENTS

Figure 1:
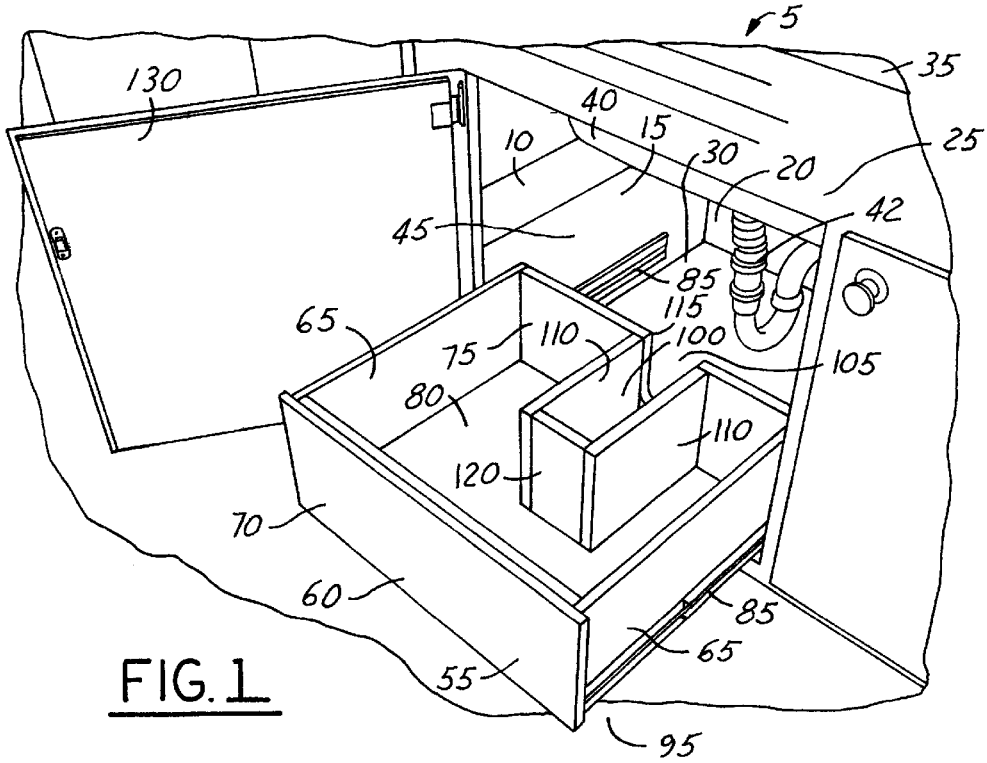
FIG. 1 is a perspective view of a first embodiment of the cabinet and drawer assembly shown in an open position.

With reference to FIG. 1, there is shown a first embodiment of the cabinet of the present invention. The cabinet frame structure 10 includes opposing side surfaces 15, a back surface 20, a front surface 25 that includes an opening 30 formed therein, and a top surface 35 for mounting a sink 40. The frame structure 10 defines an interior space 45 of the cabinet 5. Plumbing components 50 are disposed within the interior space 45 of the cabinet 5 for connection to a sink 40. A drawer assembly 55 comprising a drawer 60 having opposing side surfaces 65, a front surface 70, a back surface 75, and a bottom surface 80 is mounted within the interior space 45 of the cabinet 5. The drawer assembly 55 also includes guides 85 to facilitate mounting of the drawer 60 on the frame structure 10. The drawer assembly 55 is movable from a closed position 90 wherein the drawer assembly 55 is completely housed within the interior space 45 of the cabinet 5 and an open position 95 wherein at least a portion of the drawer assembly 55 is positioned outside the interior space 45 to allow access to the drawer assembly 55. As can be seen, the drawer assembly 55 is configured to fit within the interior space 45 when in the closed position 90 without interference with the plumbing components 50.

Figure 2:
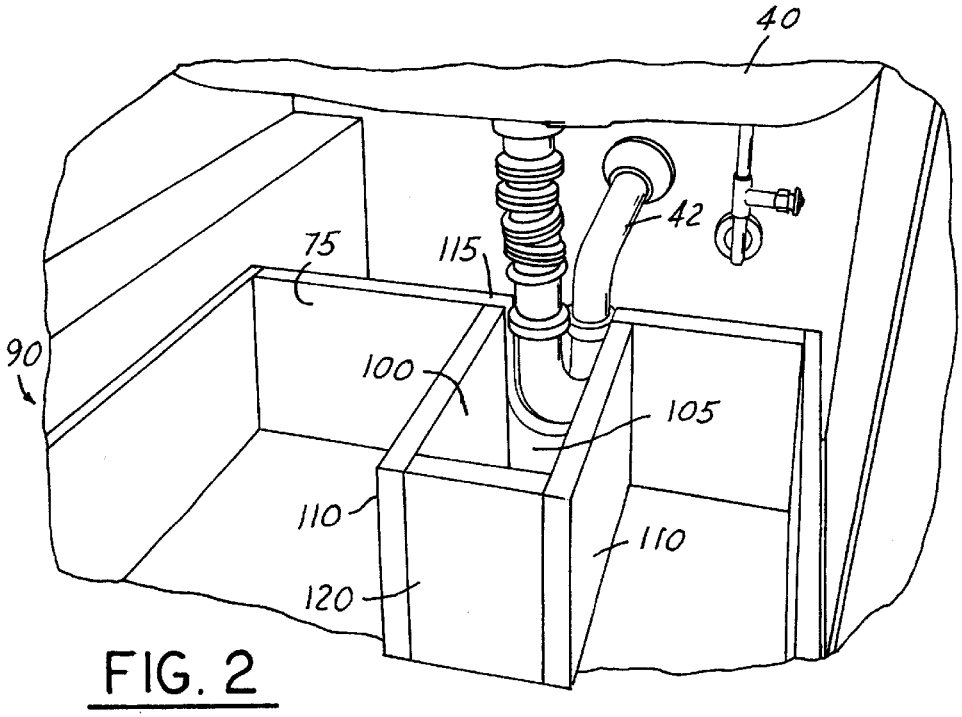
FIG. 2 is a perspective view of a first embodiment wherein the drawer assembly is partially closed and detailing the cutout section of the drawer assembly.

With reference to FIG. 1, the drawer assembly 55 is shown in the open position 95. The drawer assembly 55 of the first embodiment includes a drawer 60 having a cutout section 100 formed therein. The cutout section 100 comprises an opening 105 formed in the back surface 75 of the drawer 60. Opposing side cutout surfaces 110 are positioned at the boundaries 115 of the opening 105 and extend inboard towards the front surface 70 of the drawer assembly 60. A front cutout surface 120 connects the opposing side cutout surfaces 110. As can be seen in FIG. 1 and 2, the cutout section 100 accommodates a drain trap 42 that is attached to the sink 40.

Figure 6:
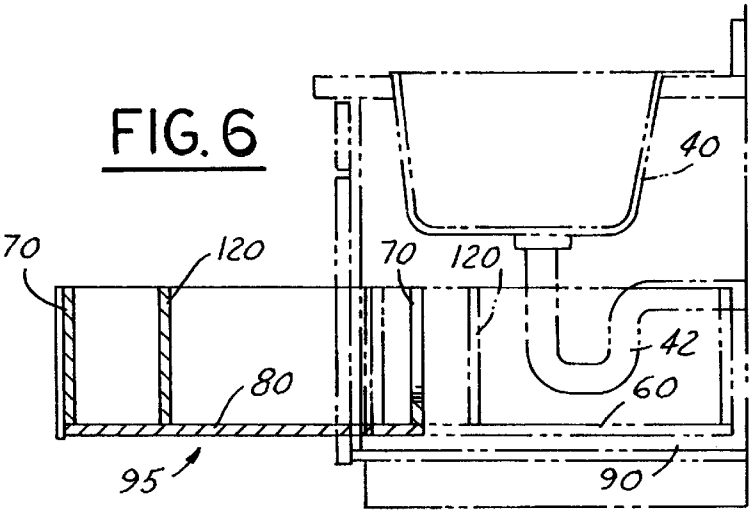
FIG. 6 is a side view of the first embodiment of the cabinet and drawer assembly in open and closed positions.
Figure 7:
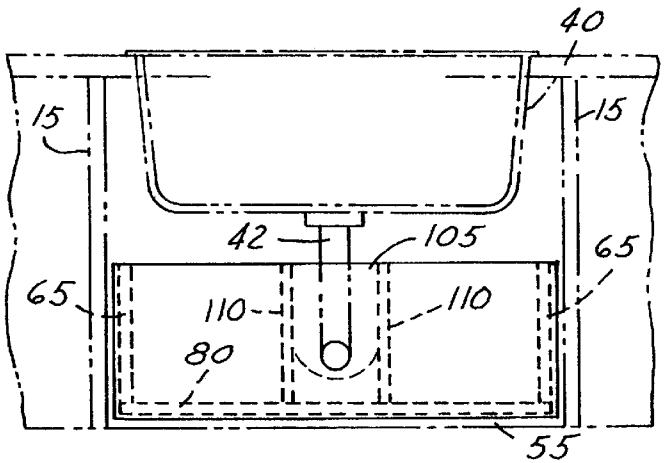
FIG. 7 is a front view of the first embodiment of the cabinet and drawer assembly of the present invention.
Figure 5:
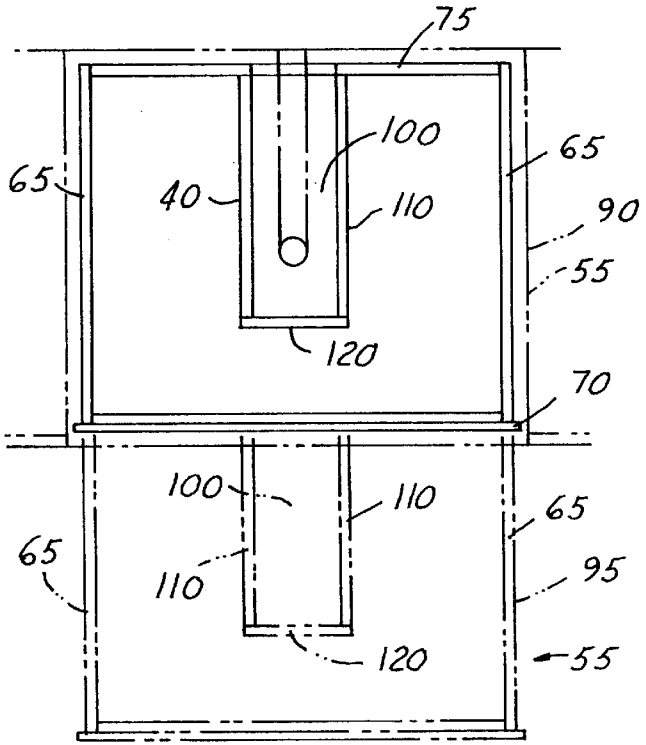
FIG. 5 is a top view of the first embodiment of the cabinet and drawer assembly shown in open and closed positions.

As shown in FIGS. 5, 6 and 7, the cutout section 100 is positioned approximately in a center along a length of the back surface 75. It is to be understood that the cutout section 100 may be positioned anywhere along a length of the back surface 75 to accommodate various positions of plumbing components 50. With reference to FIG. 5, the drawer 60 when in the open position 95 allows a person access to contents placed within the drawer 60. When in the closed position 90, the cutout section 100 houses the drain trap 42 of the sink 40 such that the drawer 60 does not interfere with the plumbing components 50, such as the drain trap 42.

Figure 3:
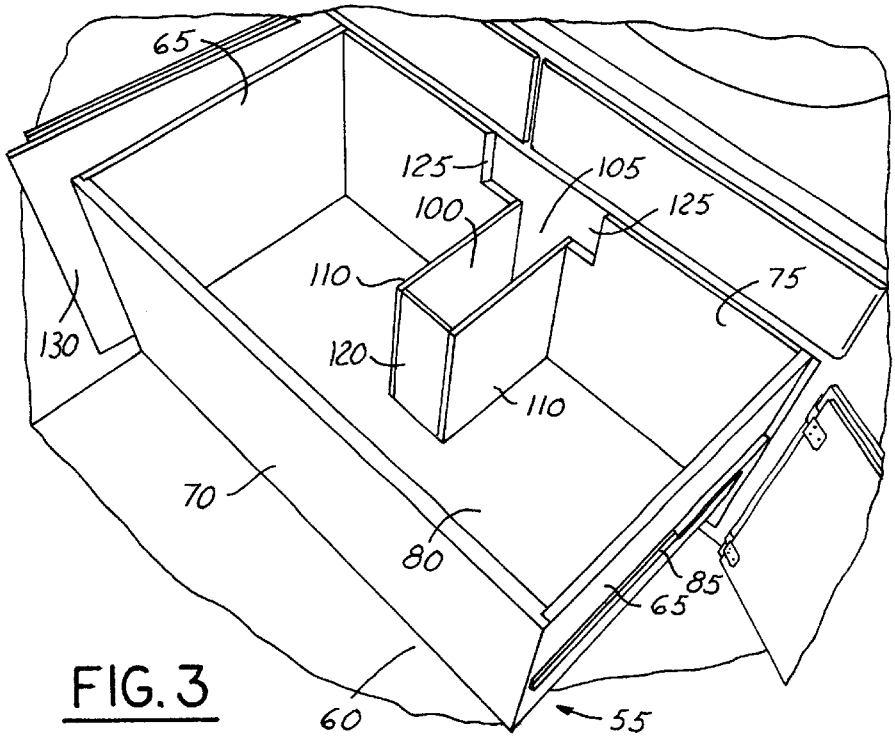
FIG. 3 is a perspective view of a second embodiment of the cabinet and drawer assembly in an open position.
Figure 8:
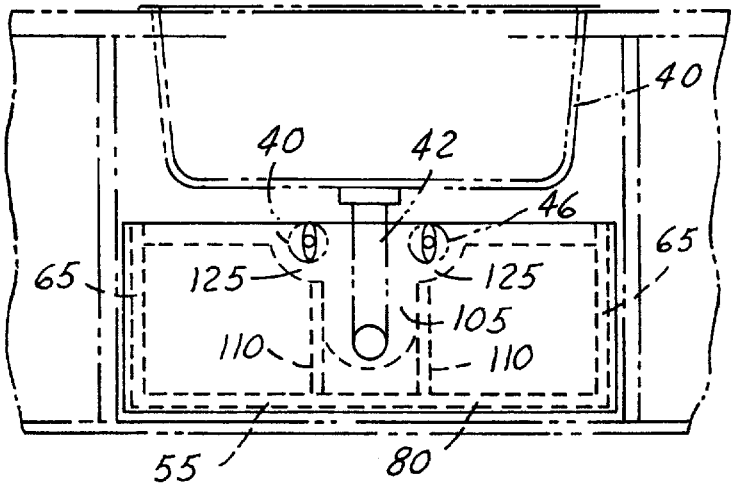
FIG. 8 is a front view of the second embodiment of the cabinet and drawer assembly of the present invention.

With reference to FIG. 3, there is shown a second embodiment of the cabinet 5 and drawer assembly 55 of the present invention. The second embodiment includes a drawer 60 wherein the back surface 75 of the drawer 60 includes at least one notch 125 formed therein to allow clearance with the plumbing components 50. In one aspect of the second embodiment, the at least one notch 125 comprises two notches for accommodating hot and cold water lines 46, 48 as shown in the front view of the second embodiment in FIG. 8. The notches 125 can have a rectangular shape, as shown in FIG. 3 or a circular shape, as shown in FIG. 8. Other shapes of notches including any number of polygonal and irregular shapes may be utilized without departing from the invention. The notches 125 as shown in FIGS. 3 and 8 are placed adjacent the cutout section 100 as previously described with reference to the first embodiment. It is to be understood that the notches may be used in combination with the cutout section 100 as detailed in FIGS. 3 and 8 or may be utilized without the cutout section 100 when such an orientation is desirable.

Figure 9:
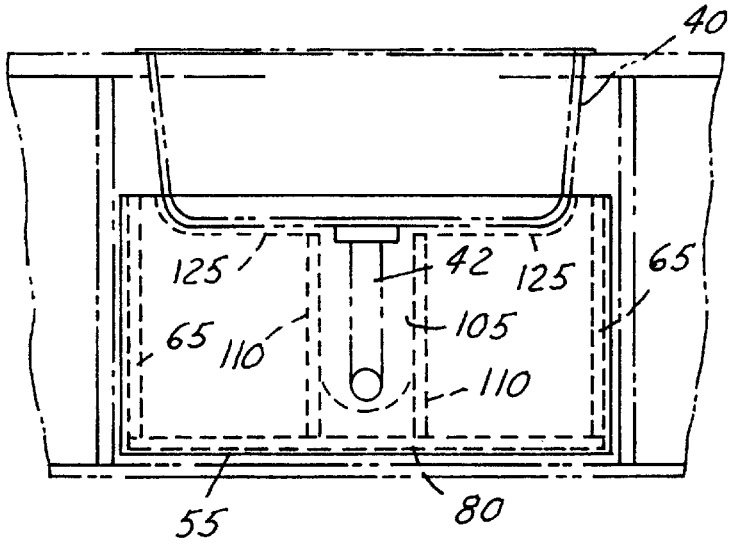
FIG. 9 is a front view of the second embodiment having notches for accommodating a sink.

As shown in FIGS. 3 and 8, the notches may be positioned along the back surface 75 of the drawer 60 next to the opening 105 formed in the back surface 75 of the cutout section 100. In this manner, the cutout section 100 can accommodate a drain trap 42, while the notches 125 accommodate hot and cold water lines 46, 48 as are commonly installed in an under sink cabinet. The size and shape of the notches 125 can be modified to accommodate various orientations of plumbing components 50. For example, as shown in FIG. 9, the notches 125 are sized to accommodate the sink 40 such that a drawer having a depth greater than the clearance from a sink can be utilized. In this manner, notches 125 can be utilized to accommodate various plumbing components 50 including the sink 40 and hot and cold water lines 46, 48 as well as other components such as an under sink hot water heater or disposal as will be discussed in more detail below.

Figure 4:
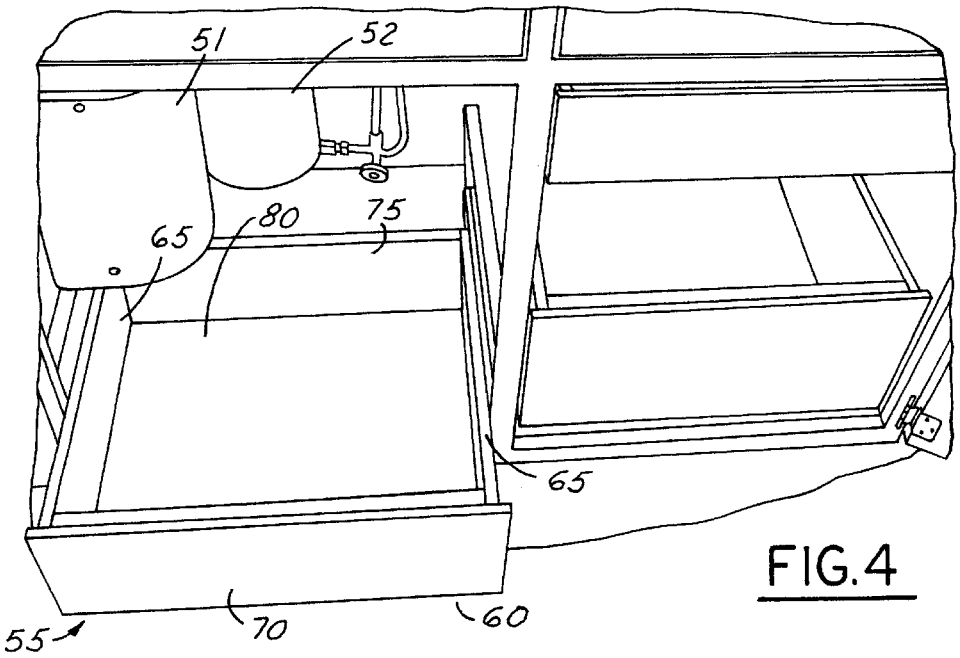
FIG. 4 is a perspective view of a third embodiment of the cabinet and drawer assembly of the present invention.

With reference to FIG. 4, there is shown a third embodiment of the cabinet and drawer assembly of the present invention. The third embodiment includes a drawer assembly 55 having a height such that it clears plumbing components 50 positioned in the cabinet. With reference to FIG. 4, there is shown a hot water heater 51, and disposal 52 positioned within the cabinet 5. As can be seen, the drawer assembly 55 includes a drawer 60 with a height below the height of the hot water heater 51 and disposal 52. There is no interference when the drawer is moved from open 95 and closed 90 positions.

In a preferred aspect of the present invention, the cabinet 5 further includes a door 130 attached to the frame structure 10. The door 130 is movable to allow access to the interior space 45 of the cabinet 5. The drawer assembly 55 when in the closed position 90 maintains a clearance between the door 130 such that the door 130 remains in an aesthetically pleasing flat position. Therefore, a person may open the door 130 and move the drawer assembly 55 from its closed position 90, where it is housed within the interior space 45 of the cabinet 5 without interference with plumbing components 50, to its open position 95 such that items placed within the drawer 60 can be added or removed in a conventional manner.

While preferred embodiments are disclosed, a worker in this art would understand that various modifications would come within the scope of the invention. Thus, the following claims should be studied to determine the scope and content of the invention.

What is claimed is:

1. A cabinet comprising:

a) a frame structure including opposite side surfaces, a back surface, a front surface having an opening formed therein, and a top surface for mounting a sink, the frame structure defining an interior space of the cabinet;

b) plumbing components disposed within the interior space of the cabinet for connection to the sink;

c) a drawer assembly comprising: a drawer having opposing side surfaces, a front surface, a back surface and a bottom surface, the drawer including guides associated therewith to facilitate mounting on the frame structure, the drawer assembly mounted within the interior space and movable from a closed position wherein the drawer assembly is completely housed within the interior space and an open position wherein a portion of the drawer assembly is positioned outside the interior space for allowing access to the drawer assembly;

the drawer assembly configured to fit within the interior space when in the closed position without interference with the plumbing components;

wherein the drawer includes a cutout section formed therein, the cutout section comprising an opening formed in the back surface of the drawer, opposing side cutout surfaces positioned at the boundaries of the opening and extending inboard towards the front surface of the drawer assembly, and a front cutout surface connecting the opposing side cutout surfaces; and wherein the cutout section accommodates a drain trap of the sink.

2. A cabinet comprising:

a) a frame structure including opposite side surfaces, a back surface, a front surface having an opening formed therein, and a top surface for mounting a sink, the frame structure defining an interior space of the cabinet;

b) plumbing components disposed within the interior space of the cabinet for connection to the sink;

c) a drawer assembly comprising: a drawer having opposing side surfaces, a front surface, a back surface and a bottom surface, the drawer including a cutout section formed therein, the cutout section comprising an opening formed in the back surface of the drawer, opposing side cutout surfaces positioned at the boundaries of the opening and extending inboard towards the front surface of the drawer assembly, and a front cutout surface connecting the opposing side cutout surfaces;

the cutout section accommodating the plumbing components such that the drawer assembly fits within the interior space when in a closed position without interference with the plumbing components.

3. The cabinet of claim 2 wherein the cutout section accommodates a drain trap of the sink.

* * * * *